US007458866B2

(12) United States Patent
Nakamura et al.

(10) Patent No.: US 7,458,866 B2
(45) Date of Patent: Dec. 2, 2008

(54) OUTBOARD DRIVE WITH SPEED CHANGE MECHANISM

(75) Inventors: Daisuke Nakamura, Shizuoka-ken (JP); Isao Fujii, Shizuoka-ken (JP); Ken Wakui, Shizuoka-ken (JP)

(73) Assignee: Yamaha Marine Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/285,715

(22) Filed: Nov. 21, 2005

(65) Prior Publication Data

US 2006/0116034 A1 Jun. 1, 2006

(30) Foreign Application Priority Data

Nov. 19, 2004 (JP) ..... 2004-335556
Aug. 19, 2005 (JP) ..... 2005-238761

(51) Int. Cl.
*B63H 20/14* (2006.01)

(52) U.S. Cl. ..... 440/75

(58) Field of Classification Search ..... 440/89 J, 440/75

See application file for complete search history.

(56) References Cited

U.S. PATENT DOCUMENTS

| | | | | | |
|---|---|---|---|---|---|
| 1,389,712 | A * | 9/1921 | Thompson et al. | ..... | 440/55 |
| 3,601,226 | A * | 8/1971 | Masaoka et al. | ..... | 184/6.28 |
| 4,331,432 | A * | 5/1982 | Blanchard | ..... | 440/75 |
| 5,733,217 | A * | 3/1998 | Naraki et al. | ..... | 475/258 |
| 6,196,887 | B1 * | 3/2001 | Ogasawara | ..... | 440/75 |
| 2001/0019982 | A1 * | 9/2001 | Yoo | ..... | 475/312 |

FOREIGN PATENT DOCUMENTS

| | | |
|---|---|---|
| JP | 01-273790 | 11/1989 |
| JP | 07-081684 | 3/1995 |

* cited by examiner

*Primary Examiner*—Stephen Avila
(74) *Attorney, Agent, or Firm*—Knobbe, Martens, Olson & Bear, LLP

(57) ABSTRACT

An outboard drive includes a prime mover having an output shaft. A driveshaft is coupled with the output shaft. Both shafts having axes that extend at least generally parallel to each other. A propulsion device is coupled with the driveshaft. The prime mover rotates the output shaft to drive the propulsion device through the driveshaft. A speed change mechanism is positioned between the output shaft and the driveshaft. The speed change mechanism changes a rotational speed of the output shaft transmitted to the driveshaft.

9 Claims, 12 Drawing Sheets

OUTBOARD DRIVE WITH SPEED CHANGE MECHANISM

CROSS-REFERENCE TO RELATED APPLICATIONS

The present application is based on and claims priority under 35 U.S.C. § 119 to Japanese Patent Applications No. 2004-335556, filed on Nov. 19, 2004, and No. 2005-238761, filed on Aug. 19, 2005, the entire contents of which are hereby expressly incorporated by reference herein.

BACKGROUND OF THE INVENTION

1. Field of the Invention

The present invention generally relates to an outboard drive with a speed change mechanism (e.g., a transmission) and, more particularly, to an outboard drive having a speed change mechanism for transmitting a rotational speed different from an output speed of a prime mover.

2. Description of Related Art

Outboard drives are coupled with an associated watercraft to propel the watercraft forward or backward. Outboard motors are typical one kind of such outboard drives.

Typically, outboard motors include a drive unit and a mount unit. The mount unit can be fixed to a transom board for mounting the drive unit on an associated watercraft. The drive unit includes an engine at the top thereof as a prime mover. The engine has a crankshaft that generally extends vertically as an output shaft of the engine. A driveshaft is coupled with the crankshaft and extends downward from the crankshaft. A propulsion shaft is coupled with the driveshaft and extends generally normal to the driveshaft. Typically, a propeller is coupled with the driveshaft. A casing normally houses the driveshaft and the propeller shaft.

The crankshaft rotates in the engine. The rotation of the crankshaft is transmitted to the propeller through the driveshaft and the propeller shaft. The propeller thus rotates to generate thrust for propelling the watercraft.

Some outboard motors include a speed change mechanism or transmission that changes a rotational speed of the crankshaft to a different speed and transmits the changed speed to the propulsion shaft. For example, Japanese Patent No. 2785200 discloses an outboard motor having a planetary gearing mechanism as the speed change mechanism. The driveshaft of this outboard motor is divided into an upper portion and a lower portion. The planetary gearing mechanism is interposed between the upper and lower portions of the driveshaft. Thus, at least a mid portion of the casing, which encloses the driveshaft, needs to have a larger size to enclose the planetary gearing mechanism. That is, the casing must be larger, at least in this portion, which spoils the external appearance of the outboard motor. On the other hand, if the whole casing is enlarged to improve the external appearance, the submerged portion of the casing will produce more drag as the result of its enlarged size.

SUMMARY OF THE INVENTION

A need thus exists for an outboard drive such as, for example, an outboard motor that can incorporate a speed change mechanism without making a casing large.

To address such needs, in accordance with one aspect of the present invention, an outboard motor includes a prime mover having an output shaft. A driveshaft is coupled with the output shaft. A propulsion device is coupled with the driveshaft. The prime mover rotates the output shaft to drive the propulsion device through the driveshaft. A speed change mechanism is positioned between the output shaft and the driveshaft. The speed change mechanism changes a rotational speed of the output shaft transmitted to the driveshaft.

In accordance with another aspect of the present invention, an outboard motor includes an engine having a crankshaft. A casing is disposed below the engine. A driveshaft extends through the casing. Coupling means are provided for coupling the driveshaft with the crankshaft. The coupling means drive the driveshaft at a speed slower than a rotational speed of the crankshaft.

BRIEF DESCRIPTION OF THE DRAWINGS

These and other features, aspects and advantages of the present invention will now be described in connection with preferred embodiments of the invention in reference to the accompanying drawings. The illustrated embodiments, however, are merely examples and are not intended to limit the invention. The drawings include 15 figures in which.

DETAILED DESCRIPTION OF THE INVENTION

Figure 1:
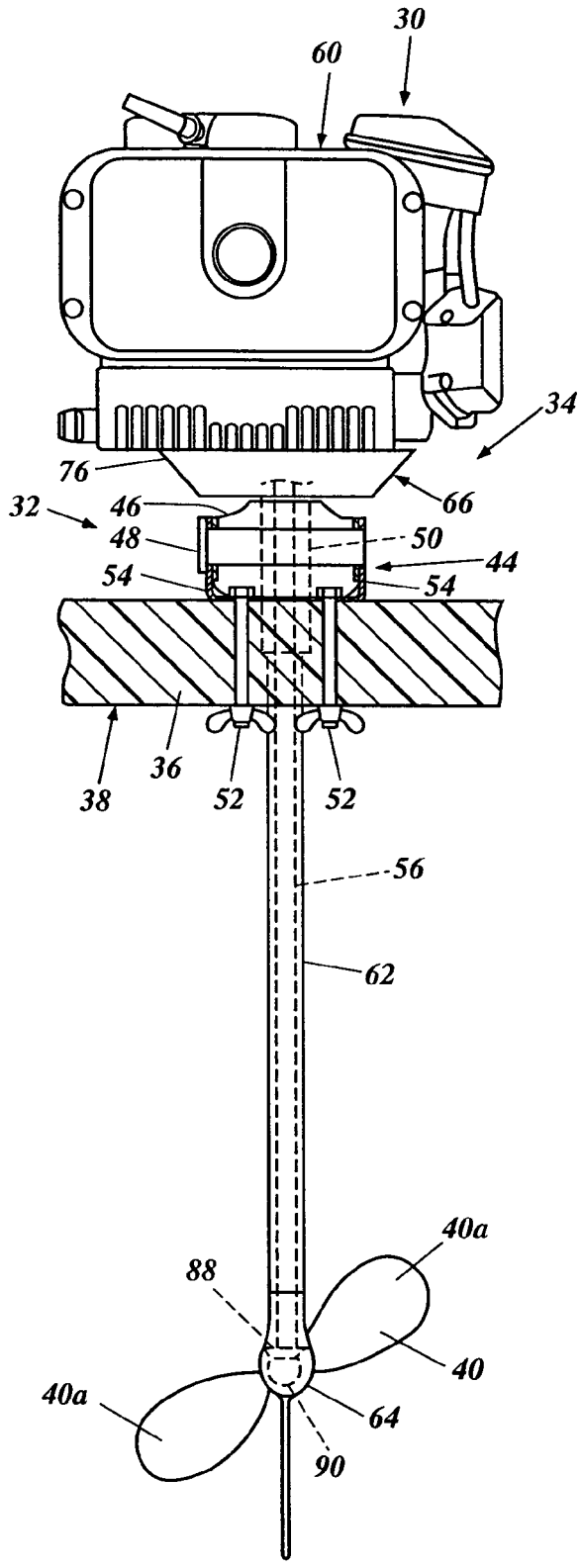
FIG. 1 is a front elevational view of an outboard motor configured in accordance with certain features, aspects and advantages of a first preferred embodiment of the present invention, a transom of an associated watercraft shown in section, and a carrying handle and a steering member are shown in phantom.
Figure 2:
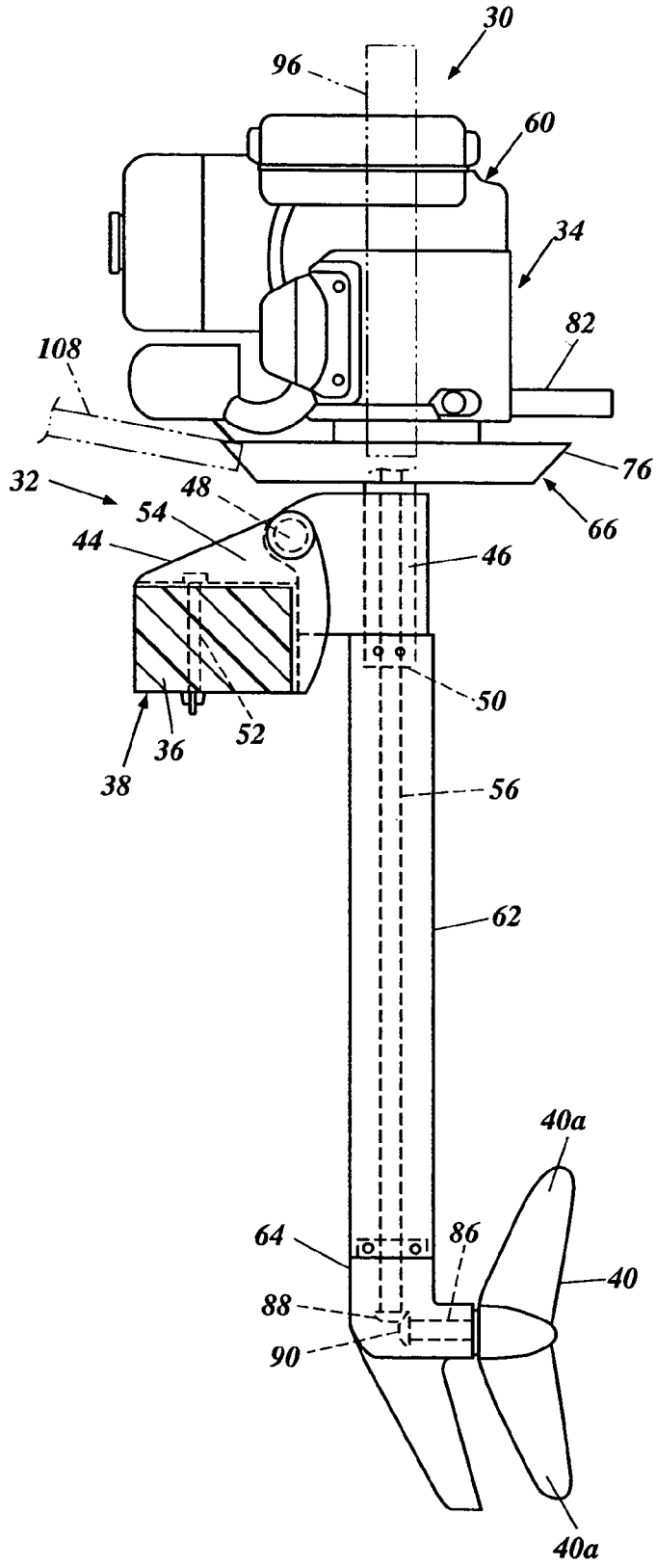
FIG. 2 is a side elevational view of the outboard motor of FIG. 1 with a cowling of the outboard motor being detached.

With reference to FIGS. 1 and 2, an overall structure of an outboard motor 30 that is a preferred embodiment of the present invention will be described below. The outboard motor 30 merely exemplifies one type of outboard drive. The present invention can apply to other outboard drives whether the drives are called outboard motors or not.

The outboard motor 30 preferably has a mount unit 32 and a drive unit 34. The mount unit 32 supports the drive unit 34 on a transom board 36 of an associated watercraft 38 and places a marine propulsion device such as, for example, a propeller 40, which belongs to the drive unit 34, in a submerged position with the watercraft 38 resting relative to a surface of the body of water. The drive unit 34 can be tilted up (raised) or tilted down (lowered) relative to the watercraft 38.

As used through this description, the terms "forward" and "front" mean at or to the side where the mount unit 32 is located, unless indicated otherwise or otherwise readily apparent from the context used. Also, the terms "rear," "rearward" and "backward" mean at or to the opposite side of the front side.

Also, as used in this description, the term "horizontally" means that the subject portions, members or components extend generally parallel to the water surface when the watercraft 38 is substantially stationary with respect to the water surface and when the drive unit 34 is not tilted and is generally placed in the position shown in FIGS. 1 and 2. The term "vertically" means that portions, members or components extend generally normal to those that extend horizontally.

The mount unit 32 preferably includes a clamping bracket 44, a swivel bracket 46 and a tilt pin 48. The transom board 36 of the watercraft 38 has a portion extending generally horizontally and rearward. The clamping bracket 44 is detachably fixed to this portion of the transom board 36. The swivel bracket 46 is coupled with the clamping bracket 44 by the tilt pin 48 for pivotal movement about an axis of the tilt pin 48 extending generally horizontally. The swivel bracket 46 carries the drive unit 34 for pivotal movement about an axis of a steering shaft 50 extending generally vertically. The drive unit 34 has the steering shaft 50.

More specifically, in the illustrated embodiment, the clamping bracket 44 is fixed to the transom board 36 by a pair of bolts 52. The clamping bracket 44 preferably has a pair of portions 54 spaced apart transversely and extending upward. The tilt pin 48 extends through both of the spaced portions 54 and fixed to those portions. A front end of the swivel bracket 46 is placed between the spaced portions 54 of the clamping bracket 44. The remainder of the swivel bracket extends rearward more than a location of the tilt pin 48 to support the steering shaft 50.

The steering shaft 50 preferably has a cylindrical shape. The illustrated swivel bracket 46 has one or more bearings to journal the steering shaft 50. A driveshaft 56, which will be described in greater detail below, extends through the steering shaft 50.

The drive unit 34 preferably includes a prime mover. In the illustrated embodiment, the prime mover is an internal combustion engine 60. Other prime movers such as, for example an electric motor can replace the engine 60.

The drive unit 34 also includes an upper casing 62, a lower casing 64, a speed change unit 66 and the propeller 40. The engine 60 is disposed atop of the drive unit 34. The upper casing 62 depends from the steering shaft 50 to extend downward. A top end of the upper casing 62 is preferably coupled with a bottom end of the steering shaft 50. The lower casing 64 depends from the upper casing 62 to further extend downward. A top end of the lower casing 64 is preferably coupled with a bottom end of the upper casing 62.

The speed change unit 66 has a speed change mechanism 74 (see FIGS. 7 and 8) and a housing 76 enclosing the speed change mechanism 74. The housing 76 is fixed to a top end of the steering shaft 50. The speed change mechanism 74 in the illustrated embodiment is a planetary gear mechanism. The speed change mechanism 74 changes an output speed of the engine 60 and outputs the changed speed to a next component, i.e., the driveshaft 56 in this embodiment. The illustrated speed change mechanism 74 reduces the output speed of the engine 60 to a lower speed. The speed change mechanism 74 will be described in greater detail below with reference to FIGS. 7 and 8.

The engine 60 in the illustrated embodiment is an air cooling, four stroke engine and is mounted on the housing 76 of the speed change unit 66. The engine 60 has a crankshaft 78 (see FIG. 7) extending generally vertically. The engine 60 is preferably surrounded by a cowling 80 (see FIGS. 3-6). However, the illustrated cowling 80 does not entirely cover the engine 60. That is, a rear bottom portion of the engine 60 is exposed outside of the cowling 80.

As shown in FIG. 2, the engine 60 preferably has an exhaust pipe 82 extending rearward and positioned above the speed change unit 66 to discharge exhaust gases to the atmosphere. Preferably, the exhaust pipe 82 extends beyond the cowling 80 to open at an external location thereof. Because the engine 60 is almost surrounded by the cowling 80, a compulsory air cooling device (not shown) is preferably provided for the engine 60 to introduce air into the internal cavity of the cowling 80. The air cooling device preferably includes a fan and a shroud.

The illustrated upper casing 62 is formed with a tubular member made of aluminum alloy. A cross-section of the upper casing 62 in a horizontal plane preferably is an elliptic shape that has a major axis extending in a fore to aft direction. The driveshaft 56 extends through the upper casing 62. A cross sectional area of the upper casing 62 in the horizontal plane can be small enough because only a space for allowing the driveshaft 56 to extend therethrough is necessary. This is because, in the illustrated embodiment, the upper casing 62 does not need to involve a cooling water passage through which cooling water, drawn from the body of water, flows to the engine. In addition, the exhaust pipe 82 does not extend through the upper casing 62, as discussed above. Thus, the upper casing 62 can be shaped as slim as possible.

The upper casing 62 in this embodiment has a fixed cross sectional area in every horizontal plane. In other words, the upper casing 62 has the same configuration from top to bottom. The upper casing thus can be easily formed by extrusion and thereby be mass produced. Production cost of the upper casing 62 thus can be reduced.

In the illustrated embodiment, a top end of the driveshaft 56 is fixed to the steering shaft 50 or the housing 76 of the speed change unit 66 for rotation via a bearing. Also, a bottom end of the driveshaft 56 is fixed to the lower casing 64 for rotation via another bearing.

The lower casing 64 also has a slim shape to extend continuously from the upper casing 62 and turns rearward to meet the propeller 40. The lower casing 64 is preferably produced by a casting.

The illustrated propeller 40 has two blades **40*a*. Each blade 40*a* is larger than a blade which is used usually so as to generate larger thrust force at a relatively low speed. That is, the propeller 40** has a larger outer diameter and a smaller boss diameter than a propeller usually used in similar applications.

That is, the blade aspect ratio of this propeller 40 is larger than that of a conventional propeller for an outboard motor.

A top of the driveshaft 56 is coupled with a bottom end of the crankshaft 78 through the speed change mechanism 74. A coupling construction will be described below. The driveshaft 56 thus can rotate together with the crankshaft 78. However, a rotational speed of the driveshaft 56 is changed by the speed change mechanism 74 to be different from a rotational speed of the crankshaft 78.

As shown in FIG. 2, a propeller shaft 86 preferably extends normal to the driveshaft 56 within the lower casing 64. The propeller shaft 86 is fixed to the lower casing 64 for rotation via one or more bearing. The propeller 40 is coupled with a rear end of the propeller shaft 86. A bottom end of the driveshaft 56 has a bevel gear 88, while a front end of the propeller shaft 86 has another bevel gear 90. Both the bevel gears 88, 90 engage with each other. The propeller shaft 86 thus rotates together with the driveshaft 56 to generate a thrust force. Additionally, the lower casing 64 acts as a gear case because the lower casing 64 incorporates the bevel gears 88, 90 therein.

In the illustrated embodiment, a rotational speed of the propeller shaft 86 is always equal to a rotational speed of the driveshaft 56 because the bevel gears 88, 90 have the same number of teeth. Alternatively, the bevel gears 88, 90 can have different number of teeth from one another. For example, if the bevel gear 90 has a larger number of teeth than the bevel gear 80, the propeller shaft 86 rotates at a lower speed relative to the speed of the driveshaft 56.

The drive unit 34 in the illustrated embodiment can be steered. That is, the steering shaft 50 can pivot about the axis thereof relative to the swivel bracket 46. When the drive unit 34 is placed as shown in FIGS. 1 and 2, the propeller 40 is positioned right behind the lower casing 64. The associated watercraft 38 thus can move forward. When the drive unit 34 is steered rightward or leftward with a certain angle from the position of FIGS. 1 and 2, the watercraft 38 can turn rightward or leftward, respectively. When the drive unit 34 is turned 180 degrees from the position shown in FIGS. 1 and 2 to place the propeller 40 in front of the lower casing 64, the watercraft 38 can move backward.

Figure 4:
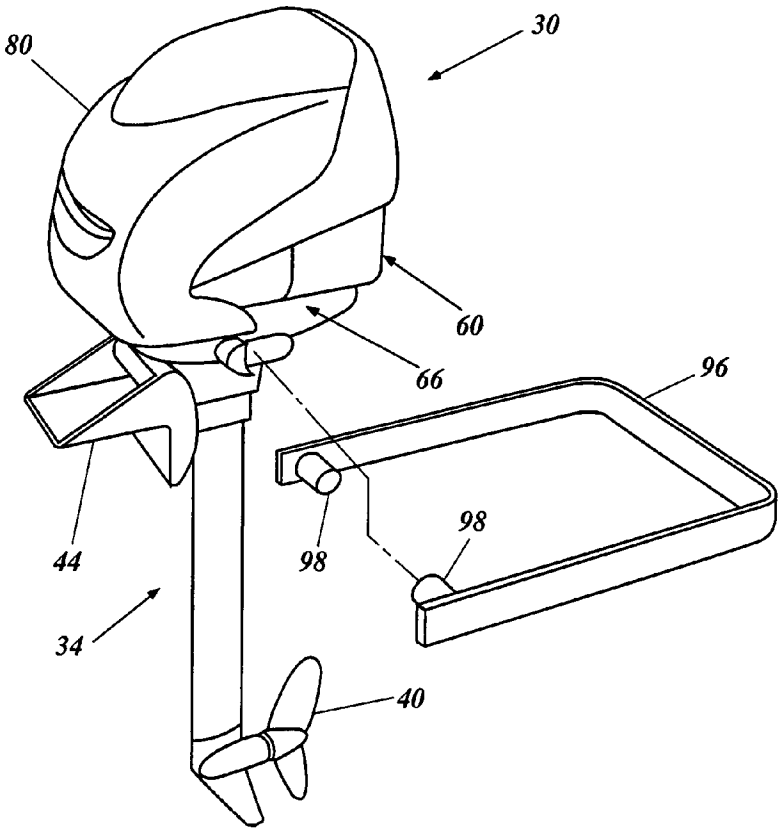
FIG. 4 is a perspective view of the outboard motor, the carrying handle being separated.
Figure 3:
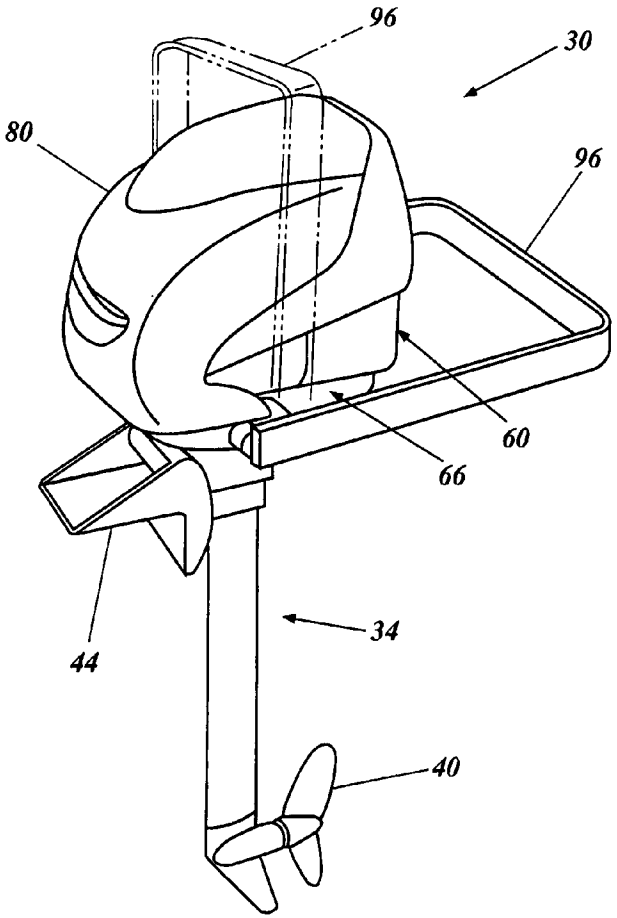
FIG. 3 is a perspective view of the outboard motor with a carrying handle.

With reference to FIGS. 2-4, in order to steer the drive unit 34, a carrying handle 96 is used in this embodiment. The carrying handle 96 is preferably configured as a U-shape. The carrying handle 96 has mount shafts 98 at both ends. The respective mount shafts 98 are fixed to both sides of a rigid portion of the drive unit 34 such as, for example, the housing 76 of the speed change unit 66 or the engine 60 for pivotal movement about an axis extending transversely. Primarily, the carrying handle 96 extends upward as shown in FIGS. 1 and 3 so as to be used for carrying the outboard motor 30. When the carrying handle 96 extends generally horizontally, it can be used as a steering member. That is, when the watercraft 38 moves forward and the carrying handle 96 extends oppositely relative to the propeller 40, the operator can steer the drive unit 34 using the carrying handle 96 because the carrying handle 96 is directed forward. On the other hand, when the watercraft 38 moves backward and the carrying handle 96 extends in the same side as the propeller 40 as shown in FIG. 3, the operator also can steer the drive unit 34 using the carrying handle 96 because the carrying handle 96 is also directed forward.

Figure 6:
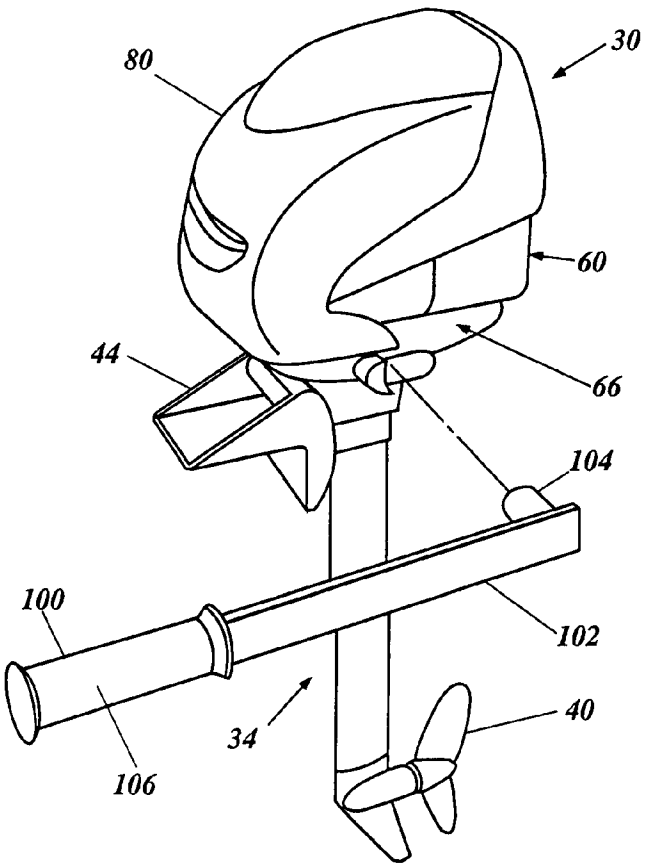
FIG. 6 is a perspective view of the outboard motor, the handle bar being separated.
Figure 5:
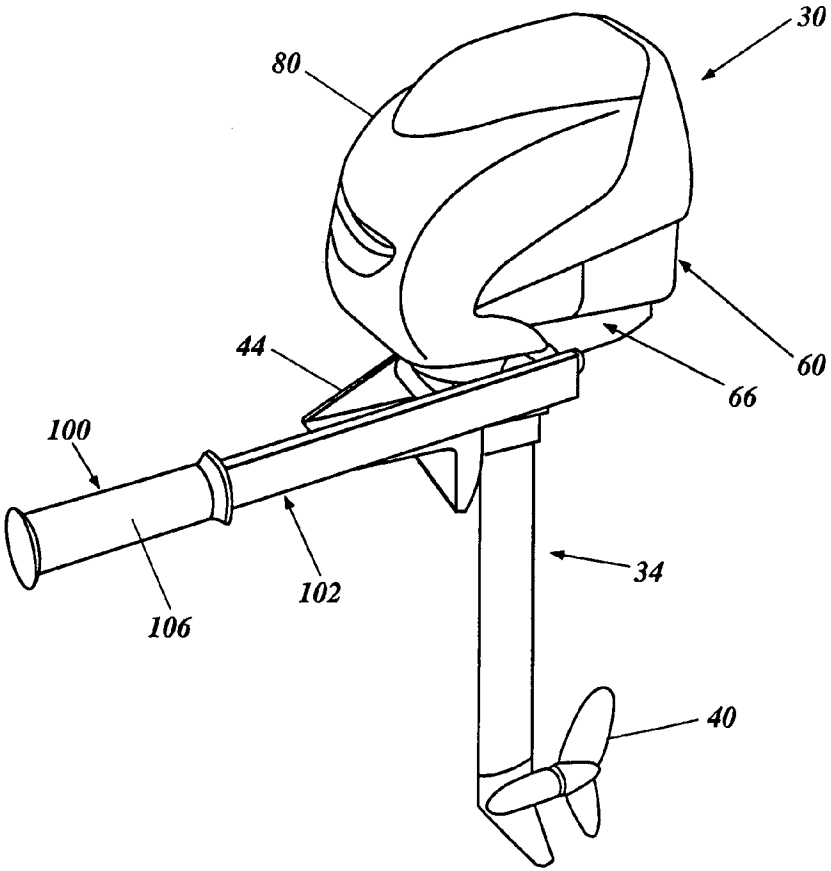
FIG. 5 is a perspective view of the outboard motor with a handle bar.

With reference to FIGS. 5 and 6, a steering handle bar 100, which is formed with a rod 102, can replace the carrying handle 96 or, in an alternative arrangement, be provided in addition to the carrying handle 96. The steering handle bar 100 is fixed to the side end of the housing 76 of the speed change unit 66 on the left hand side for pivotal movement similarly to the carrying handle 96. The steering handle bar 100 has a mount shaft 104 at an end thereof. The mount shaft 104 is fixed to the side of the rigid portion of the drive unit 34 such as, for example, the housing 76 of the speed change unit 66 or the engine 60 for pivotal movement. The steering handle bar 100 also has a grip 106 at the other end thereof so that the operator can take hold of the steering bar 100. When the watercraft 38 moves forward, the steering handle bar 100 extends in the opposite direction relative to the propeller 40. The steering handle bar 100, however, can pivot to extend on the same side of the propeller 40, which is directed forward when the watercraft 38 moves backward, so that the operator of the outboard motor 30 can steer the drive unit 34 also under this condition.

In another alternative, a detachable steering member 108 can be provided as shown in FIG. 2. The illustrated steering member 108 is detachably fixed to a front end of the housing 76 of the speed change unit 66.

Figure 7:
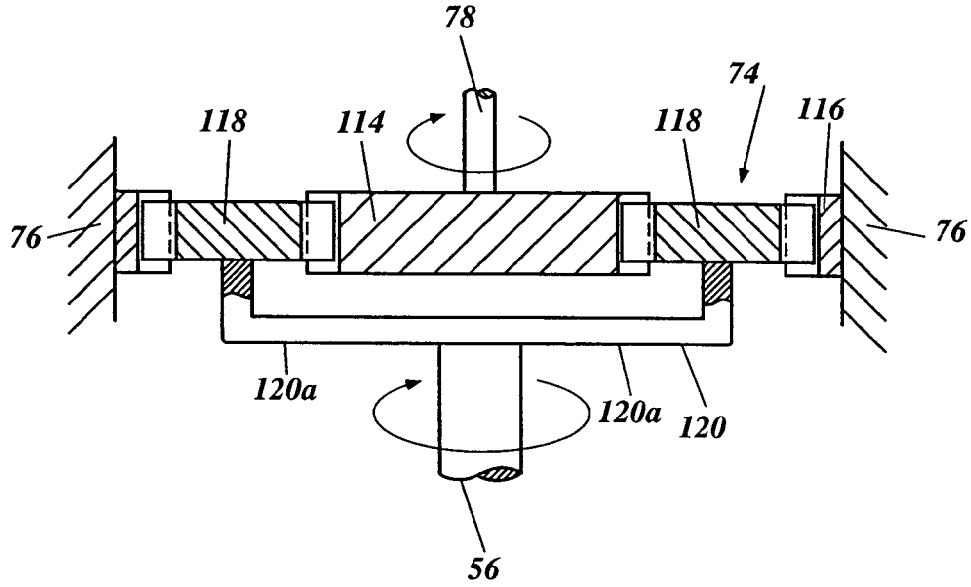
FIG. 7 is a cross-sectional view of a speed change mechanism (planetary gearing mechanism) of the outboard motor of FIG. 1.
Figure 8:
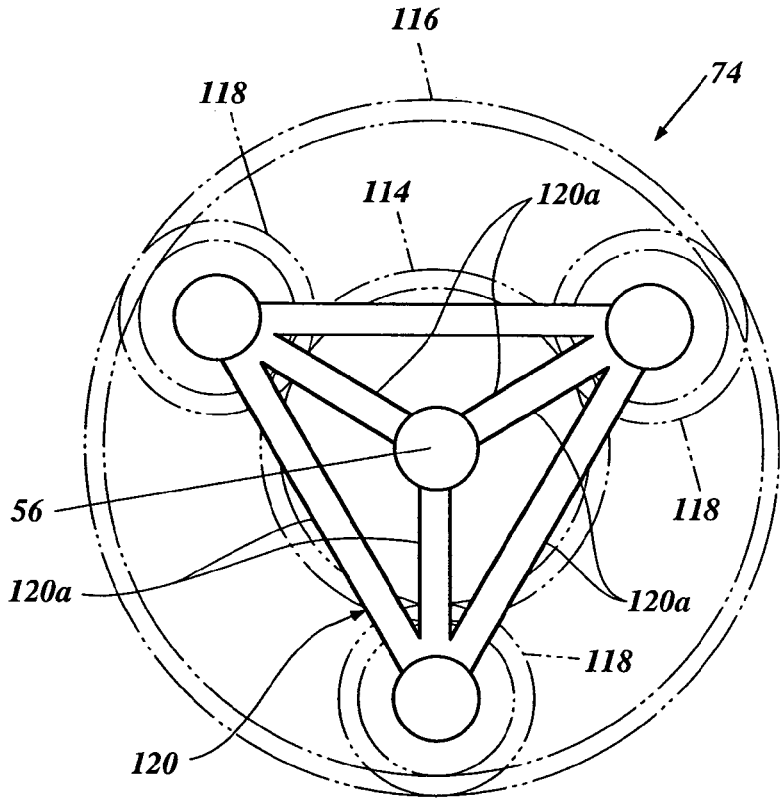
FIG. 8 is a bottom plan view of the speed change mechanism 9 of FIG. 7, the mechanism being shown in phantom except for a carrier.

With reference to FIGS. 7 and 8, the speed change mechanism 74 will be described in greater detail below.

The speed change mechanism 74 in the illustrated embodiment is a planetary gear mechanism, as noted above. The planetary gear mechanism includes a sun gear 114, a ring gear 116, a plurality of planetary gears 118 and a carrier 120.

The illustrated sun gear 114 is unitarily formed with the crankshaft 78 at the bottom end thereof, although the sun gear 114 can be made separately from the crankshaft 78 and be fixed to the bottom end thereof. The sun gear 114 has teeth extending along an outer circumferential surface thereof.

The ring gear 116 is coaxially positioned with the sun gear 114 and placed in the same horizontal plane as the sun gear 114. The ring gear 116 is fixed to an inner surface of the housing 76. The ring gear 116 has teeth extending along an inner circumferential surface thereof.

In the illustrated embodiment, three planetary gears 118 are interposed between the sun gear 114 and the ring gear 116. The respective planetary gears 118 are equally spaced apart from the neighboring gears 118. That is, in the illustrated embodiment, neighboring planetary gears 118 are spaced 120 degrees from each other. Each planetary gear 118 has teeth extending along an outer circumferential surface thereof. Thus, each planetary gear 118 engages with both of the sun gear 114 and the ring gear 116.

The carrier 120 supports the planetary gears 118 for rotation and links all the planetary gears 118 with each other so that the respective planetary gears 118 revolve around the sun gear 114. More specifically, in the illustrated embodiment, a center portion of the carrier 120 is fixed to a top end of the driveshaft 56 so that the carrier 120 rotates together with the driveshaft 56 while the planetary gears 118 revolve around the sun gear 114. The carrier 120 has arm sections **120*a* extending from the center portion to the respective planetary gears 118 and also linking neighboring planetary gears 118 with each other. Each end portion of the respective arm sections 120*a* has a shaft extending upward. Each shaft portion supports the respective planetary gear 118** for rotation about an axis of the shaft portion.

Because of the construction as discussed above, the planetary gear mechanism (which constitutes the speed change mechanism 74 in this embodiment) reduces the rotational speed of the sun gear 114 and outputs the reduced speed through the carrier 120. In other words, the speed change mechanism 74 preferably reduces the rotational speed of the crankshaft 78 so that the driveshaft 56 rotates at the reduced speed. The speed change mechanism 74 in the illustrated embodiment is constructed in such a manner that the rotational speed of the carrier 120 (i.e., the rotational speed of the driveshaft 56) is ⅕of the rotational speed of the sun gear 114 (i.e., the rotational speed of the crankshaft 78). Of course, other gear reduction ratios can also be used.

Additionally, all the gears 114, 116, 118 used in this planetary gearing mechanism are spur gears. This is advantageous to have a large reduction ratio while maintaining durability.

The speed change unit 66 in the illustrated embodiment is positioned between the crankshaft 78 and the driveshaft 56 as discussed above. That is, the speed change unit 66 is placed above the upper casing 62 and below the engine 60. Thus, the speed change unit 66 does not increase the size of the upper casing 62. Consequently, the upper casing 62 can be kept slim. The lower casing 64, accordingly, does not need to be larger so as not to produce greater drag on the watercraft. In addition, because the rotational speed of the crankshaft 78 is reduced to a lower speed and transmitted to the propeller shaft 86 through the driveshaft 56, the propeller 40 can rotate at the lower speed that is efficient for generating thrust.

In the illustrated embodiment, the rotational speed of the crankshaft 78 is reduced by the speed change mechanism 74. The bevel gears 88, 90, thus, do not need to reduce the rotational speed of the driveshaft 56. The bevel gear 90 accordingly does not need to be larger. The lower casing 64 thus can keep its compact size and can contribute to decreasing drag on the watercraft.

The reduction ratio of the illustrated speed change mechanism 74 preferably is 5:1 as noted above. That is, the rotational speed of the crankshaft 78 is significantly reduced. This means that the driveshaft 56 rotates at a relatively slow speed and an input torque of the bevel gears 88, 90 is larger than usual. Thus, the bearing (or contact pressure) at respective tooth surfaces can be large. In the illustrated embodiment, however, the bevel gears 88, 90 are constructed so that the driveshaft 56 and the propeller shaft 86 can rotate at the same speed. As a result, the relative slip amount between the respective tooth surfaces can be minimized. The PV value (bearing and slip speed) thus can be large. Consequently, the bevel gears 88, 90 can have higher durability than those that are used in conventional outboard motors.

Additionally, in keeping the advantages discussed above, it is allowable that the bevel gear 90 of the propeller shaft is made slightly larger than the bevel gear 88 of the driveshaft 56. The combination of the bevel gear 88 and this slightly larger bevel gear 90 can slightly reduce the rotational speed of the driveshaft 56 further.

If the large reduction of rotational speed is made at the bevel gears 88, 90, these gears 88, 90 preferably will have undercut portion at each tooth thereof. However, because such a large reduction of rotational speed is not made at the bevel gears 88, 90 in this embodiment, no under cut portions are used. Thus, a forging method which brings in so-called liquefaction of the steel structure can apply. The bevel gears 88, 90 produced by this forging method can have sufficient strength to withstand the bending stress affected on the teeth by the increased torque. The durability of the bevel gears 88, 90 accordingly can be more improved.

The speed change unit 66 preferably is positioned above the axis of tilt pin 48. The weight of the speed change unit 66 thus helps the operator to tilt the drive unit 34 up about the axis of the tilt pin 48. That is, the operator can easily raise the lower casing 64 together with the propeller 40 out of the body of water.

In addition, the illustrated engine 60 has the air cooling system and also the exhaust system that discharges exhaust gases to the atmosphere. The upper casing 62 thus has no cooling system nor exhaust system. The upper casing 62 accordingly can be kept slim.

In alternative constructions, other conventional speed change mechanism or speed reduction mechanism can replace the planetary gearing mechanism. Also, a plurality of speed change or reduction mechanisms can apply. For example, such mechanisms can be placed one above another. The total reduction ratio thereof can be manually or automatically changed.

In the illustrated embodiment, the ring gear 116 of the planetary gearing mechanism (speed change mechanism 74) is fixed to the housing 76. Thus, the driveshaft 56 is always coupled with the crankshaft 78 through the speed change mechanism 74. Because the bevel gears 88, 90 are also coupled with each other at all times, the propeller 40 does not stop its rotation unless the operation of the engine 60 is stopped. Occasionally, however, the operator may desire to stop the rotation of the propeller 40 without stopping the engine operation.

With reference to FIGS. 9-13, another outboard motor 30A configured in accordance with a second embodiment of the present invention is provided that can stop the rotation of propeller without stopping the engine operation. The same or similar members, components, units and devices described above will be assigned with the same reference numerals and are not described repeatedly unless further descriptions are necessary. The arrow FWD of FIGS. 9-11 indicates the forward direction of the associated watercraft 38. Also, the reference symbol VX of FIGS. 9-13 indicates the common axis of the crankshaft 78 and the driveshaft 56, while the reference symbol HX of FIGS. 9 and 11 indicates the axis of the propeller shaft 86.

Figure 9:
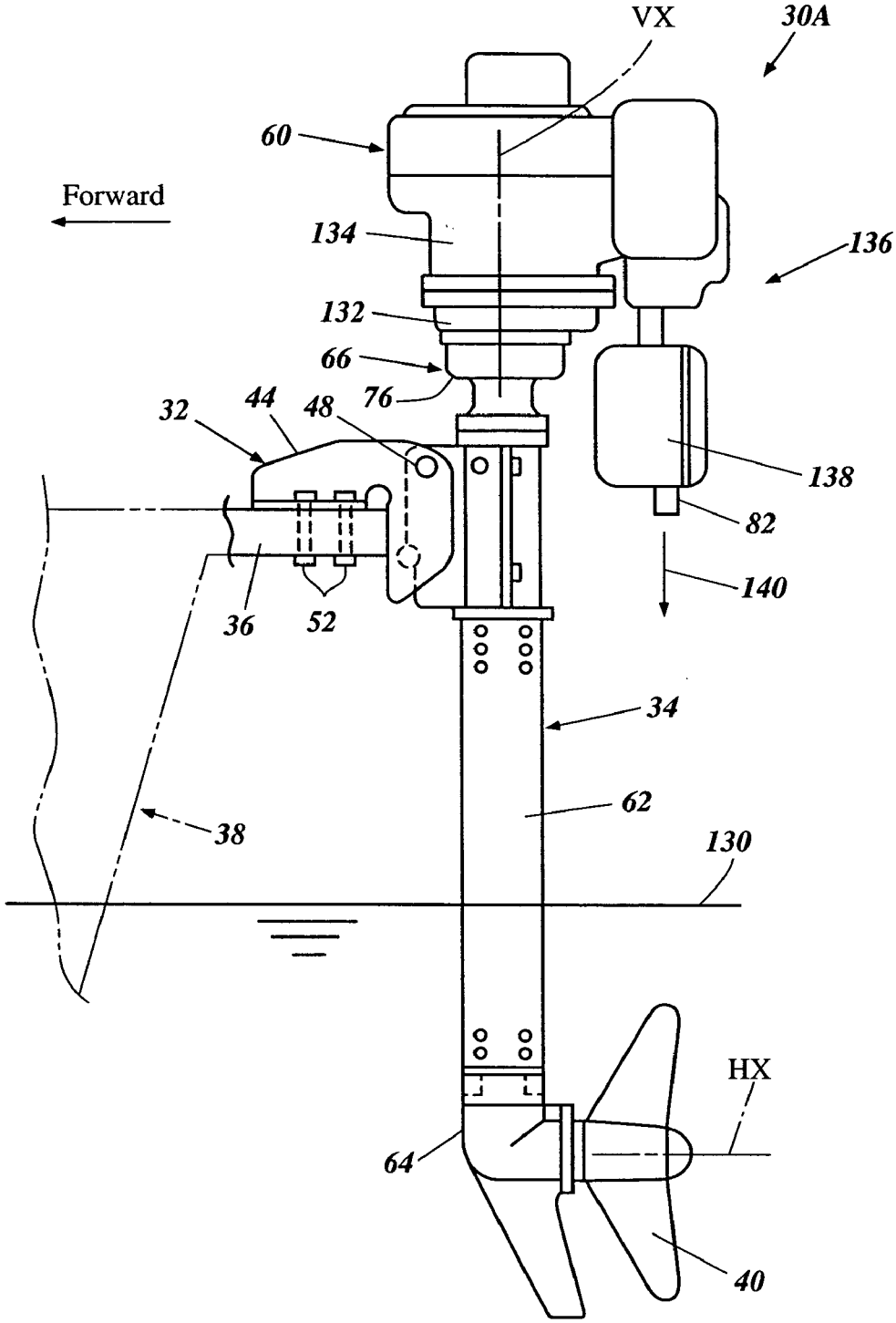
FIG. 9 is a side elevational view of another outboard motor configured in accordance with certain features, aspects and advantages of a second preferred embodiment of the present invention, and of an associated watercraft shown in phantom.

With reference to FIG. 9, a lower half of the upper casing 62 of the outboard motor 30A is submerged under a surface 130 of the body of water together with the lower casing 64 and the propeller 40 when the drive unit 34 is fully tilted down.

The engine 60 in this embodiment is an air cooling, four stroke, and single cylinder engine. The engine 60 has an oil pan 132 positioned below a crankcase 134 thereof. The engine 60 also has an exhaust device 136 for discharging exhaust gases. The illustrated exhaust device 136 generally extends downward from a rear portion of the engine 60. The exhaust device 136 includes a muffler 138 which has the exhaust pipe 82 that opens downward to discharge the exhaust gases to the atmosphere as indicated by the arrow 140 of FIG. 9.

Figure 10:
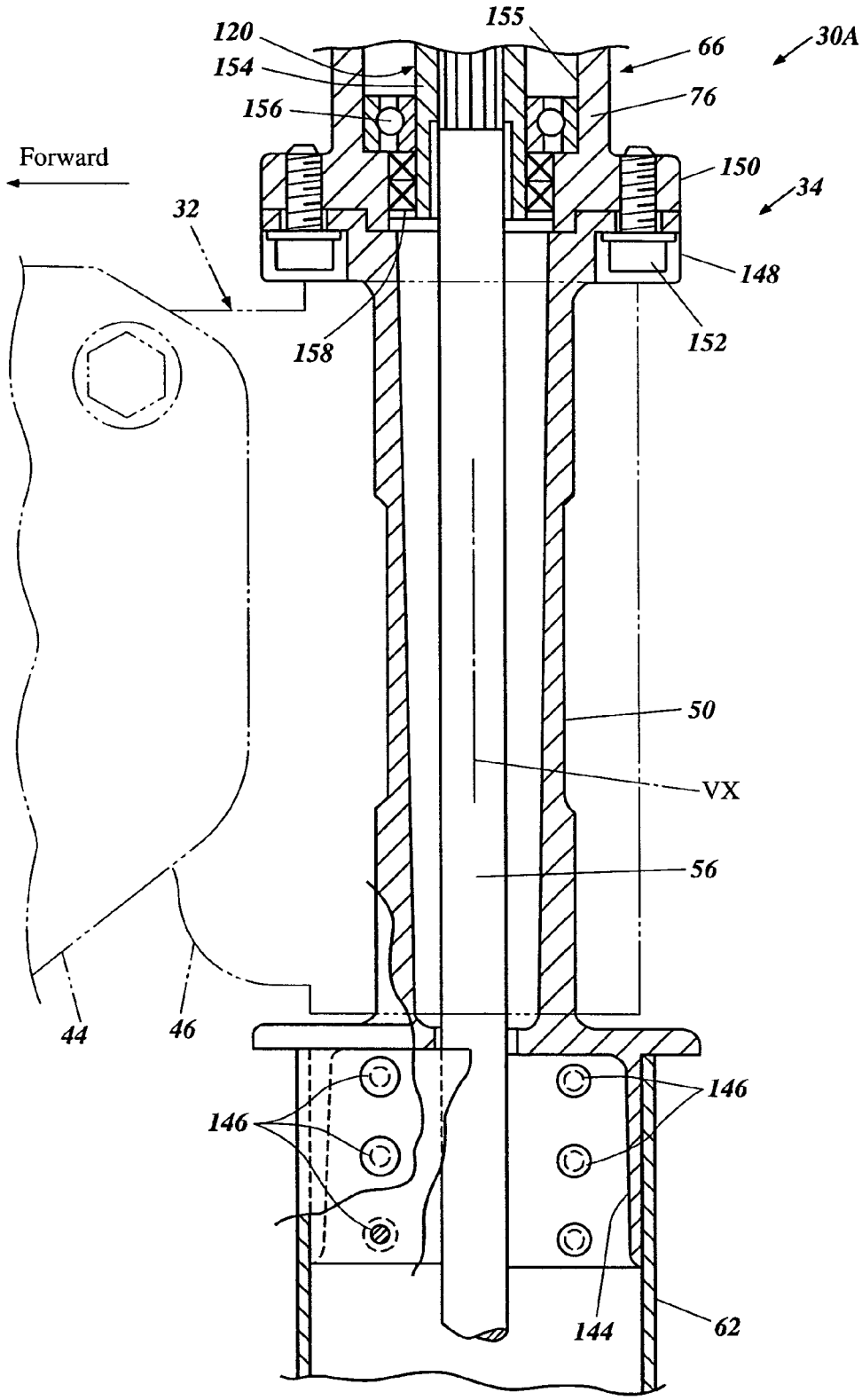
FIG. 10 is a cross-sectional view of a portion of the outboard motor of FIG. 9, showing an upper portion of a casing thereof and a mount unit (which is shown in phantom)
Figure 12:
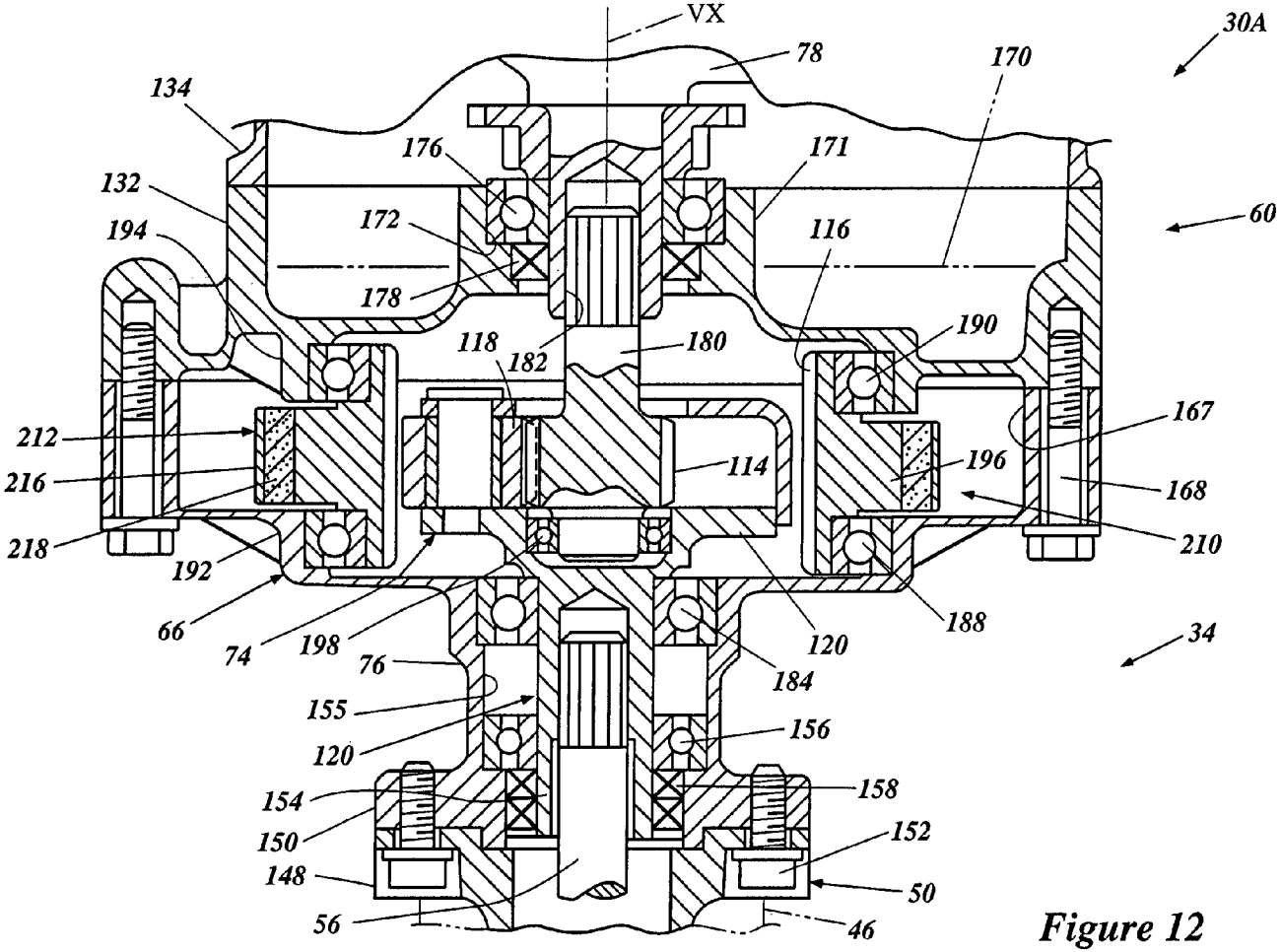
FIG. 12 is a partial, cross-sectional view of the outboard motor of FIG. 9, showing an upper portion of the casing thereof that houses a planetary gearing mechanism and a clutch device.

With reference to FIGS. 9, 10 and 12, the steering shaft 50 extends generally vertically through the swivel bracket 46. A bottom end 144 of the steering shaft 50 in this embodiment fits in a top end of the upper casing 62. A plurality of fasteners 146 couple the bottom end 144 of the steering shaft 50 and the top end of the upper casing 62.

A top end of the steering shaft 50 has a top flange 148, while a bottom end of the housing 76 of the speed change unit 66 has a bottom flange 150. The speed change unit 66 of this embodiment includes the planetary gearing mechanism arranged in the housing 76. A plurality of bolts 152 couples both of the flanges 148, 150 with each other so that the steering shaft 50 is fixed to the housing 76 of the speed change unit 66. The carrier 120 in this embodiment has an output shaft 154 unitarily formed with the carrier 120. The output shaft 154, which axis is consistent with the common axis VX, extends vertically downward through an inner cavity 155 of the housing 76. A bottom end of the output shaft 154 is fixed to the bottom end of the housing 76 for rotation via a bearing 156. Seals 158 are interposed between an inner surface of the housing 76 and an outer surface of the output shaft 154 of the carrier 120 below the bearing 156.

A top end of the driveshaft 56 preferably extends into the bottom end of the output shaft 154 of the carrier 120 beyond the top end of the steering shaft 50. In the illustrated embodiment, the top end of the driveshaft 56 is coupled with the bottom end of the output shaft 154 by spline connection for rotation together with the output shaft 154.

Figure 11:
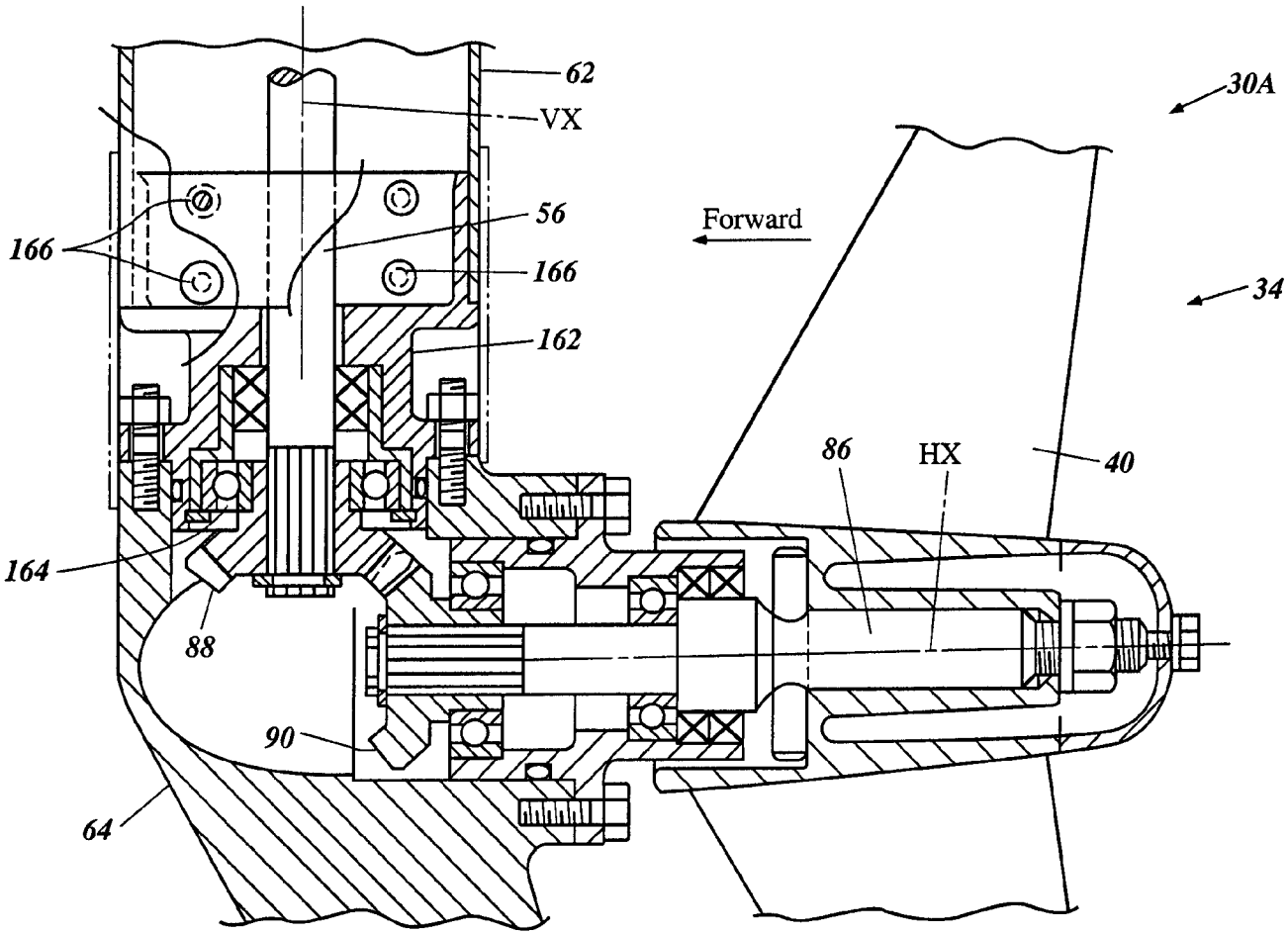
FIG. 11 is a partial, cross-sectional view of the outboard motor of FIG. 9, showing a lower portion thereof.

With reference to FIGS. 9 and 11, a support member 162, which is coupled with the lower casing 64, preferably supports a bottom end of the driveshaft 56 for rotation via a bearing 164. A top end of the support member 162 fits in a bottom end of the upper casing 62. A plurality of fasteners 166 couple the top end of the support member 162 and the bottom end of the upper casing 62 with each other.

Similarly to the outboard motor 30 described above, the bottom end of the driveshaft 56 has the bevel gear 88, while the front end of the propeller shaft 86 has the bevel gear 90. Both of the bevel gears 88, 90 engage with each other. The propeller 40 is coupled with the rear end of the propeller shaft 86.

Figure 13:
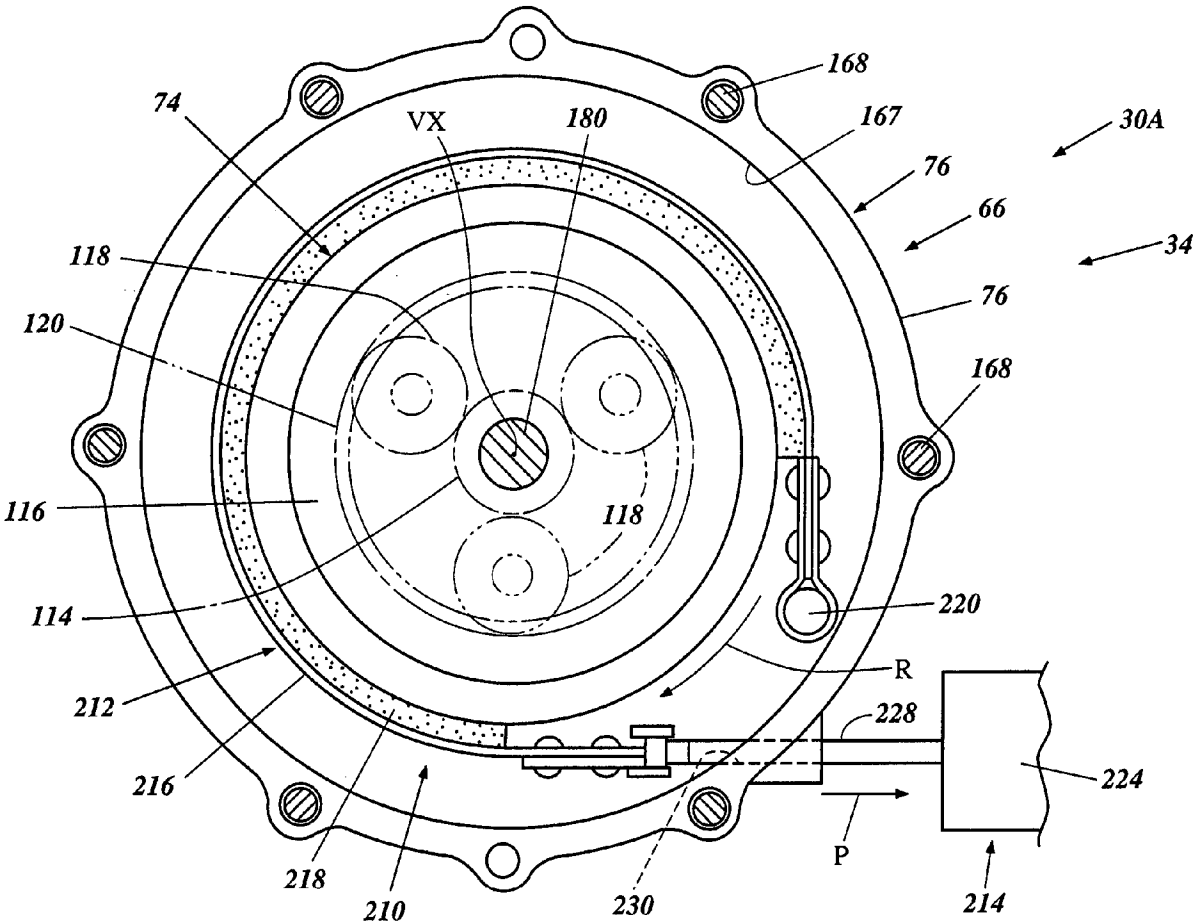
FIG. 13 is a plan view of the planetary gearing mechanism and the clutch device of FIG. 12.

With reference to FIGS. 12 and 13, a top end of the housing 76 of the speed change unit 66 preferably opens upward to have a relatively large opening 167 so that inner components such as, for examples, the sun gear 114 and the planetary gears 118 can be easily inserted into or removed therefrom. In the illustrated embodiment, the opening 167 is closed by a bottom end of the oil pan 132. The top end of the housing 76 is fixed to the bottom end of the oil pan 132 by a plurality of bolts 168.

As shown in FIG. 12, lubricant oil 170 accumulates within the oil pan 132 for lubricating engine portions. The oil pan 132 has a boss 171. The boss 171 has an aperture 172, which axis is consistent with the common axis VX. The bottom end of the crankshaft 78 extends through the aperture 172 and is fixed to the boss 171 for rotation via a bearing 176. A seal 178 is interposed between an inner surface of the boss 171 and an outer surface of the crankshaft 78 below the bearing 176.

The sun gear 114 in this embodiment has an input shaft 180 unitarily formed with the sun gear 114. The input shaft 180, which axis is consistent with the common axis VX, extends vertically upward. The crankshaft 78 has a recessed portion 182 at the bottom end thereof. A top end of the input shaft 180 fits in the recessed portion 182 and is coupled with the bottom end of the crankshaft 78 by spline connection for rotation together with the crankshaft 78.

The output shaft 154 of the carrier 120 is preferably journaled by another bearing 184 in addition to the bearing 156, although not shown in FIG. 10. This is advantageous because the axis of the output shaft 154 will not become skewed relative to or misaligned with the common axis VX.

The ring gear 116 in this embodiment is fixed to the housing 76 of the speed change unit 66 and the oil pan 132 for rotation via a lower bearing 188 and an upper bearing 190, respectively. The illustrated ring gear 116 rotates in the direction indicated by the arrow R of FIG. 13. Preferably, the housing 76 defines a lower retaining portion 192 for the lower bearing 188. The lower retaining portion 192 has an inner diameter smaller than the maximum inner diameter of the housing 76. The oil pan 132 also defines an upper retaining portion 194 for the upper bearing 190. The upper retaining portion 194 has the same inner diameter as the diameter of the lower retaining portion 192 of the housing 76. The lower retaining portion 192 of the housing 76 retains a bottom portion of the ring gear 116 via the lower bearing 188, while the upper retaining portion 194 of the oil pan 132 retains an upper portion of the ring gear 116 via the upper bearing 190. Preferably, a middle portion 196 of the ring gear 116 interposed between the lower and upper portions has an outer diameter that is larger than the inner diameter of the retaining portions 192, 194.

A top end of the carrier 120 in this embodiment supports the three planetary gears 118 for rotation. The planetary gears 118 engage with the sun gear 114 and also with the ring gear 116. The top end of the carrier 120 journals the sun gear 114 via a bearing 198. The respective planetary gears 118 thus can revolve around the sun gear 114 while being supported by the carrier 120. All the gears 114, 116, 118 preferably are spur gears also in this embodiment.

Under the circumstances, if the ring gear 116 can freely rotate relative to the housing 76, the driveshaft 56 does not rotate even though the crankshaft 78 rotates. This is because the rotation of the crankshaft 78 is not transmitted to the driveshaft 56 through the speed change mechanism 74. The free rotation of the ring gear 116 preferably is stopped so as to rotate the driveshaft 56 with the crankshaft 78.

In order to selectively stop and release the rotation of the ring gear 116, the outboard motor 30A incorporates a clutch device 210. The clutch device 210 preferably has a clutching unit 212 that prevents the ring gear 116 from rotating, and an actuating unit 214 that actuates the clutching unit 212.

The clutching unit 212 preferably includes a brake band 216 and a friction member 218 affixed to one side of the brake band. In the illustrated embodiment, the housing 76 of the speed change unit 66 has a pin 220 extending upward from a bottom surface of the housing 76. One end of the brake band 216 is fixed to the pin 220. The brake band 216 extends around an outer circumferential surface of the ring gear 116 in such a manner that the friction member 218 faces the outer circumferential surface of the ring gear 116. The actuating unit 214 preferably is a hydraulically operable actuator 224. Alternatively, other actuators such as, for example, a pneumatically or electrically operable actuator can replace the hydraulic actuator 224.

The body of the hydraulic actuator 224 is preferably fixed to the housing 76, although not shown in the figures. Alternatively, the body of the hydraulic actuator 224 can be fixed to another portion of the drive unit 34. For example, the hydraulic actuator 224 can be fixed to the engine 60 or to the cowling (not shown) that encloses the engine 60.

In the illustrated embodiment, the hydraulic actuator 224 has an actuating rod 228 extending toward the housing 76 from the body thereof. The housing 76 has an aperture 230, and the tip of the actuating rod 228 extends into the housing 76. The other end of the brake band 216 is fixed to the tip of the actuating rod 228. A control device (not shown) is provided to activate or deactivate the hydraulic actuator 224.

The hydraulic actuator 224 pulls the actuating rod 228 in the direction indicated by the arrow P of FIG. 13 when the control device activates the hydraulic actuator 224. The actuating rod 228 thus tightens the brake band 216 so that the friction member 218 firmly abuts on the outer circumferential surface of the ring gear 116. The ring gear 116 is prevented from rotating, accordingly. Under this condition, the speed change mechanism 74 works normally. That is, the driveshaft 56 rotates together with the crankshaft 78, similarly to the first embodiment described above. The rotational speed of the crankshaft 78 is reduced by the planetary gearing mechanism (i.e., speed change mechanism 74). The driveshaft 56 rotates at the reduced speed.

To decouple the driveshaft 56 from the crankshaft 78, the hydraulic actuator 224 releases the actuating rod 228 when the control device deactivates the hydraulic actuator 224. The actuating rod 228 loosens the brake band 216 so that the friction member 218 relaxes from the outer circumferential surface of the ring gear 116. The ring gear 116 thus can rotate freely. Under this condition, the speed change mechanism 74 does transmit the rotation of the crankshaft 78 to the driveshaft 56.

Alternatively, the control device can controls the hydraulic actuator 224 step by step between the fully activated state and deactivated state. Under this control, the speed reduction ratio can be changed little by little.

The clutch device 210 in this embodiment does not need large clutching force. A manually operable actuator thus can replace the hydraulic actuator 224 in another alternative as discussed below.

Figure 14:
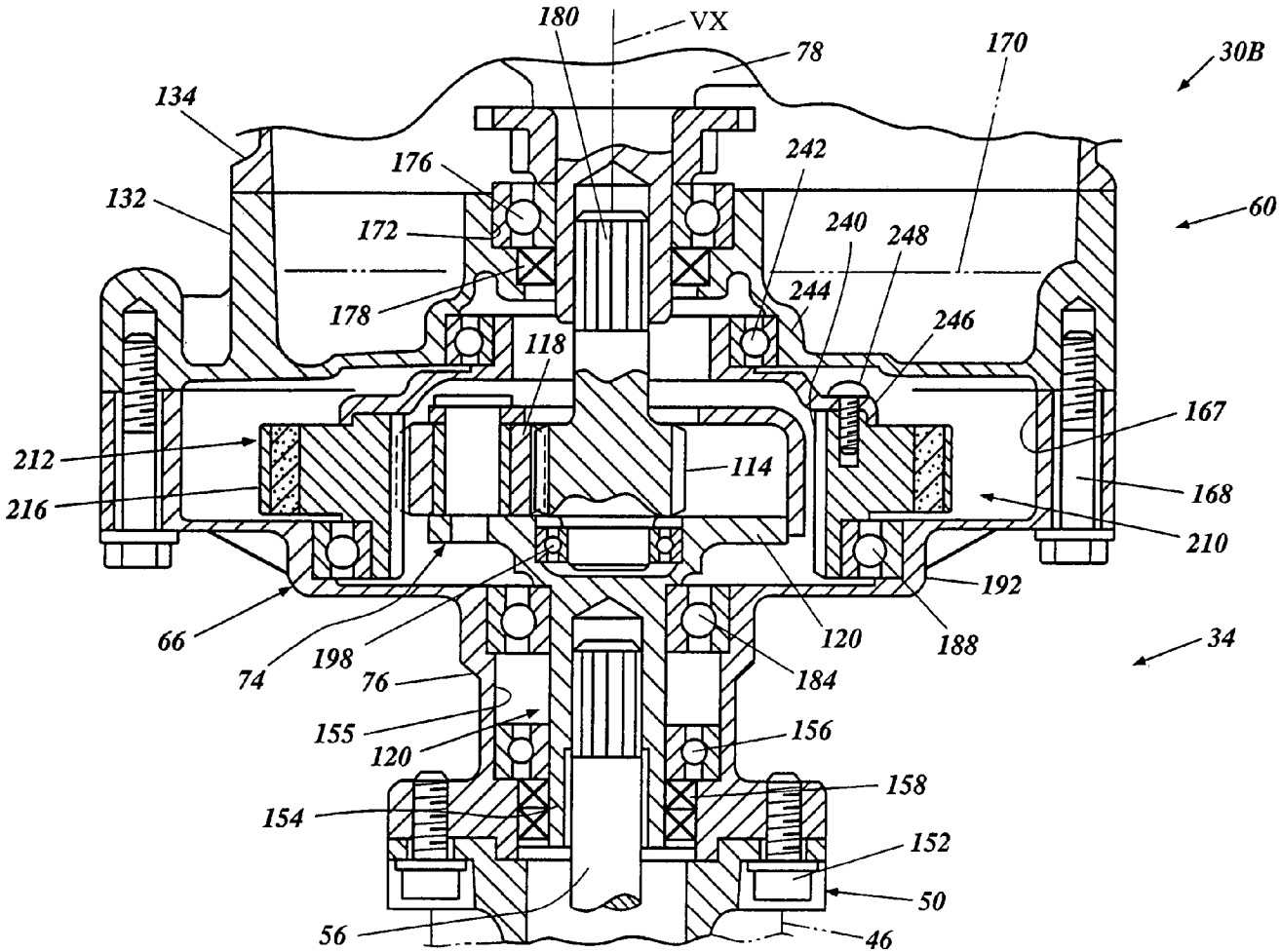
FIG. 14 is a partial, cross-sectional view of a further modified outboard motor configured in accordance with certain features, aspects and advantages of a third embodiment of the present invention, showing a portion thereof having another planetary gearing mechanism and another clutch device.
Figure 15:
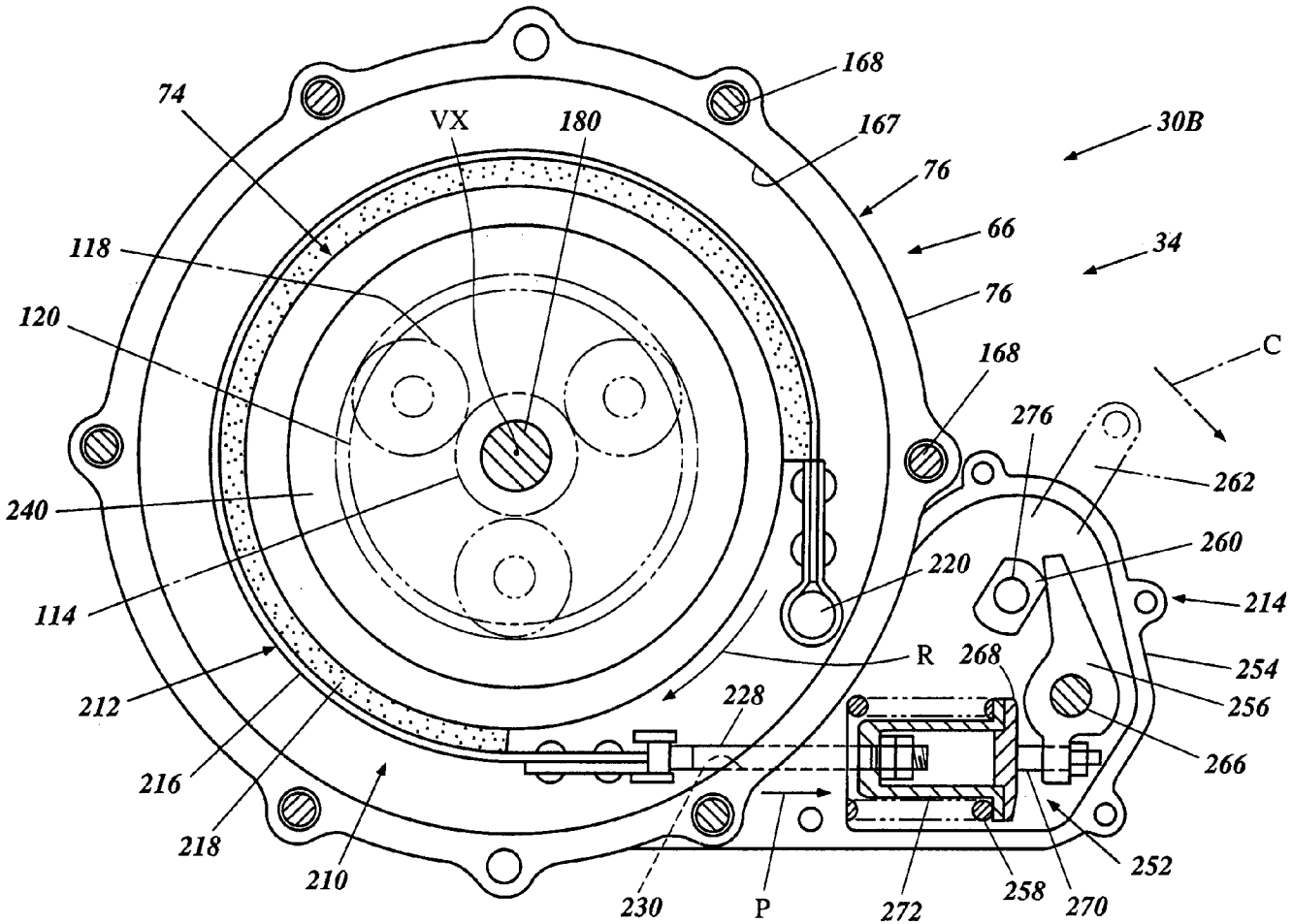
FIG. 15 is a plan view of the planetary gearing mechanism and the clutch device of FIG. 14.

With reference to FIGS. 14 and 15, a further modified outboard motor 30B configured in accordance with a third embodiment of the present invention and incorporating a manually operable actuator will be described below. The same or similar members, components, units and devices described above will be assigned with the same reference numerals and are not described repeatedly unless further descriptions are necessary.

In this embodiment, a ring gear 240 has a configuration which is slightly different from that of the ring gear 116 in the second embodiment. That is, the ring gear 240 does not have the upper portion. Also, a smaller upper bearing 242 is used in this embodiment instead of the foregoing upper bearing 190. Accordingly, an upper retaining portion 244 has a smaller inner diameter than the upper retaining portion 194. A circular extension member 246 thus extends from a top of the ring gear 240 to the upper retaining portion 244 of the housing 76. A plurality of bolts 248 fix the extension member 246 to the ring gear 240.

As thus constructed, the ring gear 240 in this embodiment can be smaller than the ring gear 116 in the second embodiment. In addition, the use of the smaller upper bearing 242 is advantageous because it can contribute to cost reduction in production of the outboard motor 30B.

As shown in FIG. 15, the outboard motor 30B incorporates the manually operable actuator 252 instead of the hydraulically operable actuator 224. The manual actuator 252 preferably includes an actuator housing 254, a swing lever 256, a coil spring 258, a cam 260 and an operational lever 262.

The actuator housing 254 houses those components therein. The swing lever 256 is fixed to the actuator housing 254 by a pin 266 for pivotal movement about an axis of the pin 266. The coil spring 258 is interposed between an inner surface of the actuator housing 254 and a retainer 268. The spring 258 normally urges the retainer 268 in a direction opposite to the inner surface of the actuator housing 254. The retainer 268 has a projection 270 extending toward the swing lever 256. One end of the swing lever 256 is coupled with the projection 270. The retainer 268 also has a cup-like member 272 surrounded by the coil spring 258. A bottom of the cup-like member 272 is positioned next to the inner surface of the housing 254.

An actuating rod 228 extends through the aperture 230 of the housing 76 of the speed change unit 66. One end of the actuating rod 228 is coupled with the brake band 216, while the other end of the actuating rod 228 is coupled with the bottom of the cup-like member 272 by a fastener.

The cam 260 is fixed to the actuator housing 254 by a pin 276 for pivotal movement about an axis of the pin 276. The other end of the swing lever 256, which is positioned opposite to the end coupled with the projection 270 of the retainer 268 relative to the pin 266, can abut on a surface of the cam 260. The operational lever 262 is also fixed to the pin 276, outside the actuator housing 254, so that the cam 260 can pivot together with the operational lever 262.

The operator can operate the clutching unit 212 using the actuating unit 214. Normally, the operational lever 262 is positioned to place the cam 260 not to contact with the swing lever 256. The coil spring 258 urges the retainer 268 together with the cup-like member 272 to the direction opposite to the inner surface of the actuator housing 254. The actuator rod 228 thus is pulled and tightens the brake band 216. The friction member 218 stops the rotation of the ring gear 240, accordingly.

When the operator moves the operational lever 262 in the direction indicated by the arrow C of FIG. 15, the cam 260 pivots and the surface of the cam 260 abuts on the swing lever 256 to rotate the swing lever 256. The swing lever 256 thus pushes the projection 270 of the retainer 268 against the urging force of the coil spring 258. The actuating rod 228 loosens the brake band 216. The ring gear 240 thus can rotate. The clutch device 210 having the manual actuator 252 can simplify the outboard motor 30A.

By incorporating the clutch device 210 as described above, the operator can stop the rotation of the propeller 40 without stopping the engine operation, even though the propeller shaft 86 is always coupled with the driveshaft 56 through the bevel gears 88, 90. That is, the outboard motors 30*a*, 30B can take a neutral state in operation without having a conventional transmission mechanism which selectively provides a forward moving state, a reverse moving state and the neutral state. The major part of the conventional transmission mechanism is usually positioned in the lower casing.

In the second and third embodiments, power to the propeller can be cutoff by stopping rotation of the ring gear. The clutch device thus is quite simple and does not require a large amount of power to operate. That is, the clutch device can be constructed with the minimum number of components. In addition, the clutch device can be positioned adjacent to the speed change unit. This is advantageous because no long component such as, for example, a shift rod, which is used for the conventional transmission mechanisms, is necessary. The drive unit thus can be slim and compact.

Also, the ring gear has a relatively large outer diameter because the ring gear surrounds the planetary gears and the sun gear. Thus, a large clutching force can be easily obtained even though frictional contact force of the friction member with the outer circumferential surface of the ring gear is relatively small. The clutch device can be simple, accordingly.

All the components or at least the major part of the clutch device can be combined with the speed change unit as a single unit. Detachability or portability of the outboard motor is not spoiled by the clutch device. In addition, because all of the components of the clutch device or at least the major part thereof can be positioned in the housing of the speed change unit, or fixed to or unitarily made with the housing, the clutch device does not disturb the steering operation of the drive unit.

Further, the illustrated actuating unit is positioned out of the housing of the speed change unit. Thus, a relatively large actuating unit can be provided, if necessary, without spoiling the compactness of the speed change unit. In addition, assembling work or maintenance work of the actuating unit can be easily made because the speed change unit does not need to be disassembled for such work.

In variations, the engine can be multi-cylinder engine. Also, the clutch device can employ a drum-brake type clutching element.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. An outboard drive comprising a prime mover having an output shaft, a driveshaft coupled with the output shaft, a propulsion device coupled with the driveshaft, the prime mover rotating the output shaft to drive the propulsion device through the driveshaft, and a speed change mechanism positioned between the output shaft and the driveshaft, the speed change mechanism being disposed in a housing and configured to change a rotational speed of the output shaft that it transmits to the driveshaft, wherein the speed change mechanism includes a planetary mechanism comprising a sun gear coupled with the output shaft, a ring gear coupled with the housing for rotation about an axis of the sun gear, and a clutch device for selectively at least slowing the rotation of the ring gear, wherein the clutch device comprises a clutching unit and an actuating unit for actuating the clutching unit, the clutching unit including a friction member extending along an outer circumferential surface of the ring gear, a first end of the clutching unit being coupled with the housing, a second end of the clutching unit being coupled with the actuating unit, and the actuating unit making the friction member abut on the outer circumferential surface of the ring gear to stop the rotation of the ring gear.

2. The outboard drive according to claim 1, wherein the actuating unit comprises a hydraulic mechanism.

3. An outboard drive comprising a prime mover having an output shaft, a driveshaft coupled with the output shaft, a propulsion device coupled with the driveshaft, the prime mover rotating the output shaft to drive the propulsion device through the driveshaft, and a speed change mechanism positioned between the output shaft and the driveshaft, the speed change mechanism being disposed in a housing and configured to change a rotational speed of the output shaft that it transmits to the driveshaft, wherein the speed change mechanism includes a planetary mechanism comprising a sun gear coupled with the output shaft, a ring gear coupled with the housing for rotation about an axis of the sun gear, and a clutch device for selectively at least slowing the rotation of the ring gear, wherein the clutch device comprises a clutching unit for inhibiting the ring gear from rotating and an actuating unit for operating the clutching unit, and the actuating unit is coupled with the housing or a body of the prime mover.

4. The outboard drive according to claim 1, wherein the housing is disposed below the prime mover, and a casing is disposed below the housing, and the driveshaft extends through the casing.

5. The outboard drive according to claim 4 additionally comprising a mount unit adapted to mount the outboard drive on an associated watercraft for pivotal movement about an axis extending generally horizontally, wherein the speed change mechanism is positioned above the axis.

6. The outboard drive according to claim 4, wherein a minimum diameter of the casing is less than a minimum diameter of the housing.

7. The outboard drive according to claim 3, wherein the housing is disposed below the prime mover, and a casing is disposed below the housing, and the driveshaft extends through the casing.

8. The outboard drive according to claim 7 additionally comprising a mount unit adapted to mount the outboard drive on an associated watercraft for pivotal movement about an axis extending generally horizontally, wherein the speed change mechanism is positioned above the axis.

9. The outboard drive according to claim 7, wherein a minimum diameter of the casing is less than a minimum diameter of the housing.

* * * * *